US006354806B1

(12) United States Patent
Bingham, Jr.

(10) Patent No.: US 6,354,806 B1
(45) Date of Patent: Mar. 12, 2002

(54) COMPRESSOR INCIPIENT SURGE DETECTION SYSTEM

(75) Inventor: William R. Bingham, Jr., Katy, TX (US)

(73) Assignee: Micon Systems, LLC, Houston, TX (US)

( * ) Notice: Subject to any disclaimer, the term of this patent is extended or adjusted under 35 U.S.C. 154(b) by 0 days.

(21) Appl. No.: 09/536,504

(22) Filed: Mar. 27, 2000

(51) Int. Cl.[7] ..... F04B 19/24
(52) U.S. Cl. ..... 417/53; 415/118; 340/945
(58) Field of Search ..... 417/53; 415/1, 415/17, 97, 118; 340/945

(56) References Cited

U.S. PATENT DOCUMENTS 3,935,558 A * 1/1976 Miller et al. ..... 340/27 SS

* cited by examiner

*Primary Examiner*—Teresa Walberg
*Assistant Examiner*—Thor Campbell
(74) *Attorney, Agent, or Firm*—David M. Ostfeld

(57) ABSTRACT

A method and apparatus are disclosed for monitoring the high-frequency of a process variable to prevent a compressor from reaching actual surge point. The detecting is accomplished by separating the high-frequency oscillation part of the process signal and transmitting the amplitude of this high-frequency oscillation component of the system signal via a controlled current loop to a controller. The circuit is housed in a small standard rail mount enclosure.

5 Claims, 3 Drawing Sheets

COMPRESSOR INCIPIENT SURGE DETECTION SYSTEM

BACKGROUND OF THE INVENTION

1. Field of the Invention

The invention relates to a method and apparatus for controlling centrifugal and axial compressor surge to enhance equipment/personnel safety and to minimize energy consumption.

2. Description of the Prior Art

Conventional surge control techniques for centrifugal and axial compressors provide for surge estimation based on the polytropic head (Hp) ratio to the volumetric suction flow rate squared ($Qs^2$). Such conventional surge control techniques are disclosed and described in publications. These conventional methods set the surge limit line of the compressor based on the surge curve data calculated by the compressor manufacturer. The conventional methods do not take process changes and compressor efficiency decreases into account. Thus the actual compressor surge limits usually differ significantly from the limits indicated on the compressor surge curve data calculated by the Compressor Manufacturer.

Microprocessor-based controllers with an anti-surge control algorithm have been used for compressor incipient surge detection. There are existing systems in the field where compressor control is handled by a distributed control system. Most compressor controls executed with distributed control systems consist of oversimplified algorithms. The main reason for this inefficient control is the speed of executing the algorithm and control system itself. Control systems without the special algorithm and speed requirements have used external devices that required special mounting and separate power wiring.

Before a compressor reaches the actual surge point rapid oscillations of flow, pressure, and current occur. Compressor field tests have confirmed this phenomena as an indication of impending surge. This invention is to provide a method and apparatus to detect incipient (impending) surge based on special conditioning of the high-speed oscillation measurement(s).

SUMMARY OF THE INVENTION

The invention relates to a method and apparatus for continuously monitoring the high frequency of a process variable signed, such as flow or pressure or driver motor current oscillations before the compressor reaches the actual surge point. This incipient surge control acts as an override control to the primary surge control and, in addition to allowing for optimum surge point setting, increases compressor/personnel safety while widening the operating window and saving energy.

The present invention uses a very simple but highly effective means of detecting an incipient surge of a compressor. Unique characterization and filtering is required to distinguish the surge characteristics of the compressor from the normal operation characteristics.

The accurate determination of the true surge control line not only eliminates the risk of encountering a surge condition, but also minimizes unnecessary wide surge margins which can result in excessive recycle/blowoff and waste of energy.

A special, high speed algorithm is required to transform pre-surge oscillations into useful data for control purposes. The detecting is accomplished by separating the high-frequency oscillation part of a process signal and transmitting the amplitude of this high-frequency oscillation component of the system signal via a controlled current loop to a controller. The circuit is housed in a small standard rail mounted enclosure.

BRIEF DESCRIPTION OF THE DRAWINGS

For a further understanding of the nature and objects of the present invention, reference should be had to the following detailed description, taken in conjunction with the accompanying drawings in which like parts are given like reference numbers and wherein.

DETAILED DESCRIPTION OF THE PREFERRED EMBODIMENT

Introduction

The improved incipient surge detection system of the preferred embodiment of the present invention may be used for controlling and monitoring centrifugal and axial compressors. Before a compressor reaches the actual surge point rapid oscillations of process variables such as flow, pressure, and current occur. These oscillations are filtered to match the characteristics of the compressor system. The peak absolute-value of the filtered signal is transmitted to a controller.

Structure and Operation

Figure 1:
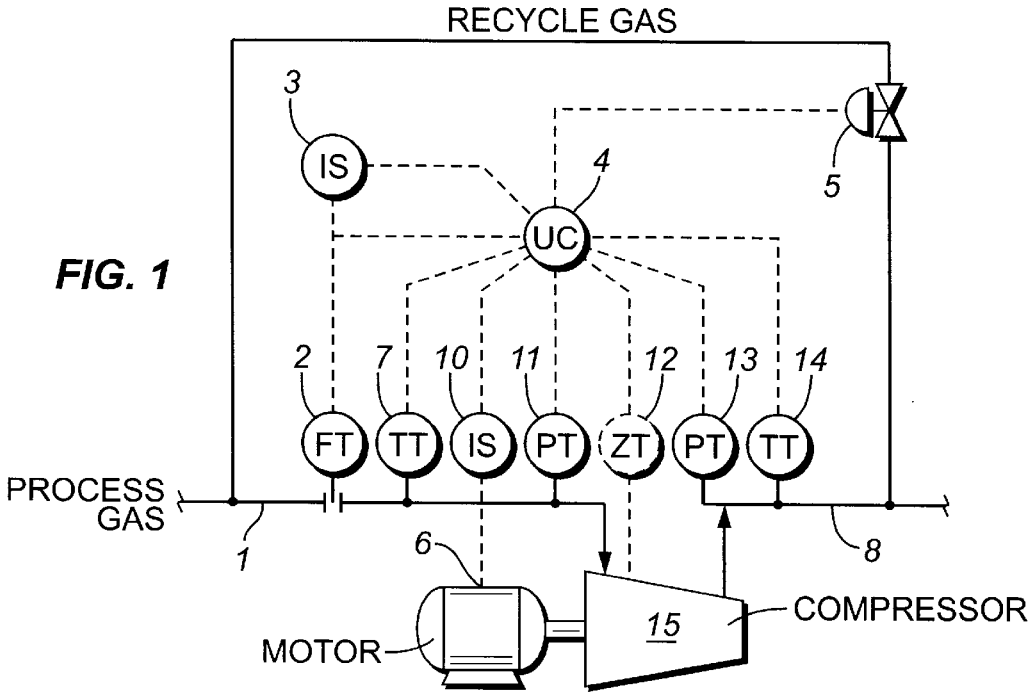
FIG. 1 is a diagram of a compressor anti-surge system showing the incipient surge detection apparatus of the present invention.

Referring to FIG. 1, there is shown a typical single stage gas compressor anti-surge control system using recycle gas as a means of preventing compressor surge. The compressor suction line 1 has a flow transmitter 2 and the motor (driver) has a current transmitter 6. The suction flow 2 signal and the motor current 6 signal are connected to the incipient surge detectors 3 and 10. The dynamic part of the suction flow signal and the current signal are processed by the incipient surge detectors 3 and 10, and the outputs are connected to an input of the anti-surge controller 4. The anti-surge controller 4 also has an input of the static flow signal from the flow transmitter 2 and inputs from other process (temperature and pressure and position) transmitters (7, 11, 12, 13 & 14). The anti-surge controller 4 manipulates the recycle valve 5 to prevent the compressor 15 from going into a surge condition.

Figure 2:
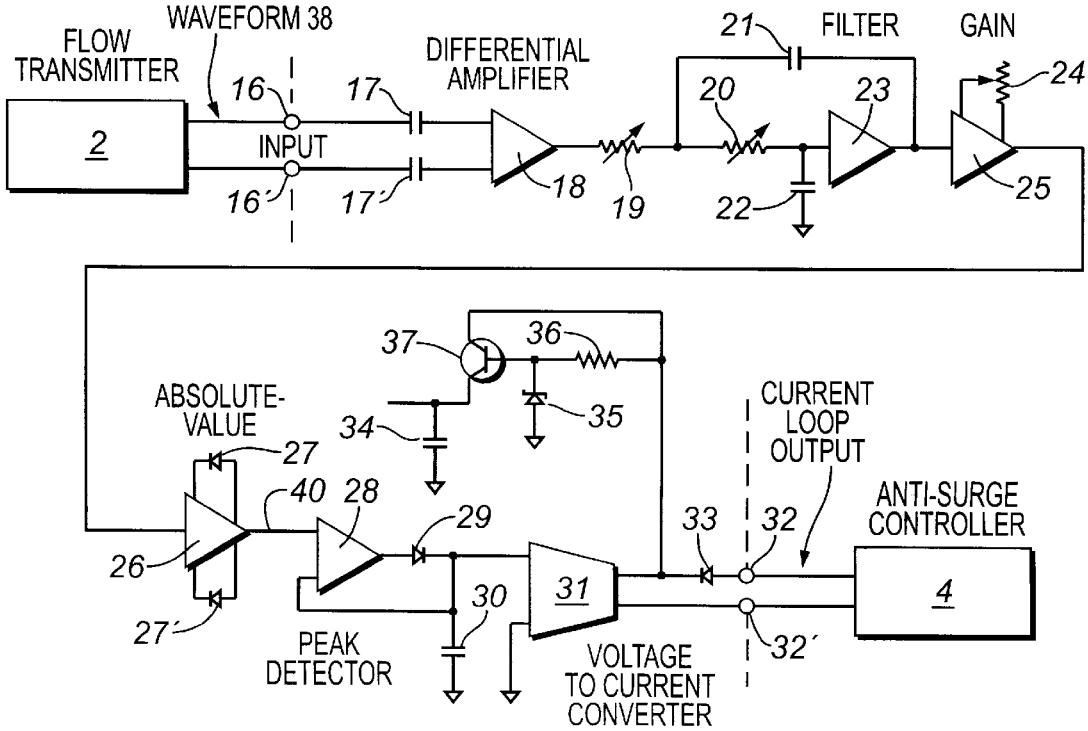
FIG. 2 is a diagram of the circuitry of the signal conditioner device of the preferred embodiment of the apparatus of the present invention used in the diagram of FIG. 1.
Figure 3:
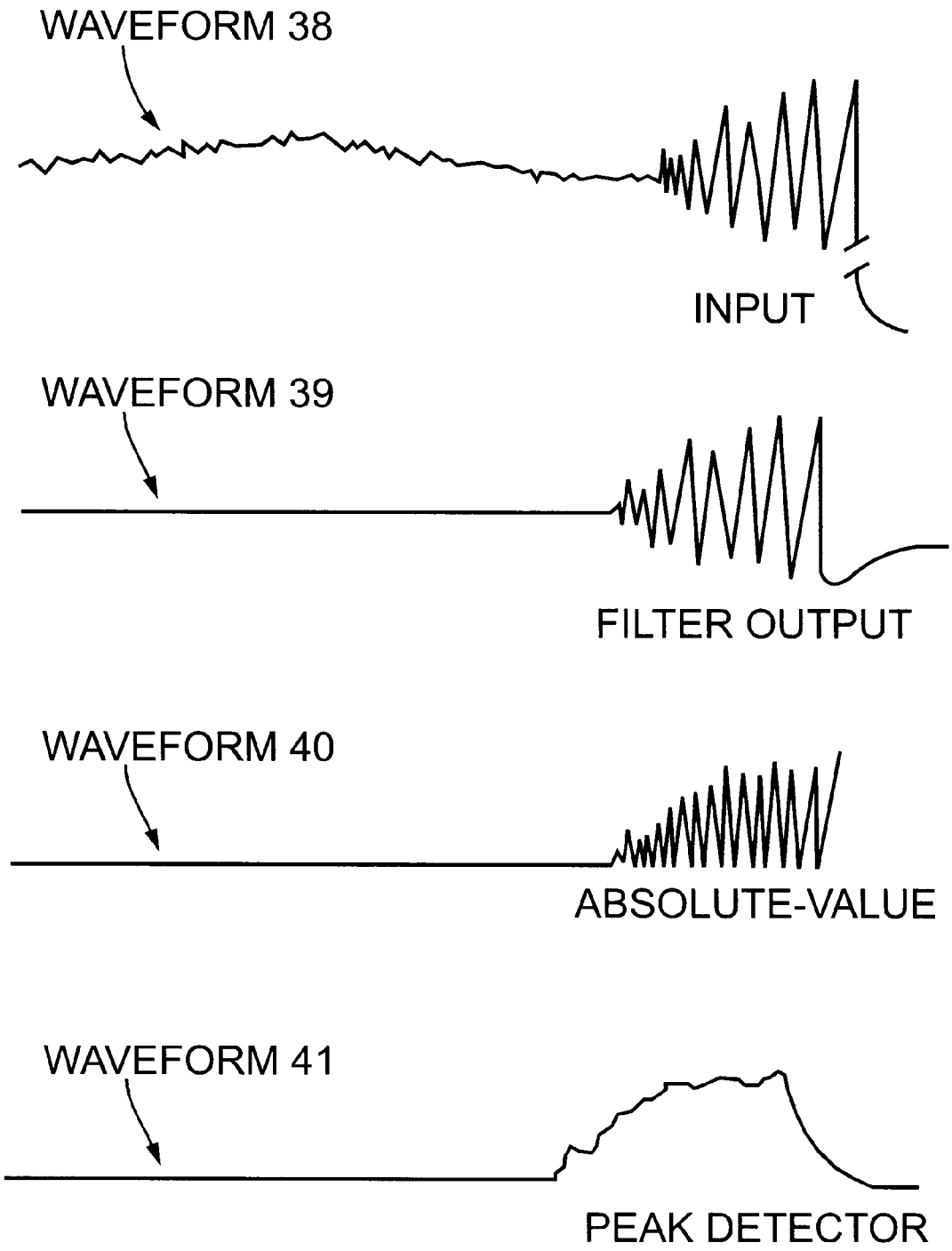
FIG. 3 is signal waveform representation of the circuit of the preferred embodiment of the apparatus of the present invention shown in FIG. 2.

Referring to FIG. 2, there is shown an input signal conditioning, detector, transmitting circuit, and power supply. The input signal conditioning part of the system is connected to a process variable such as a flow transmitter 2. The signal conditioning part of the system is composed of input terminals 16, 16', direct current (dc) blocking capacitors 17, 17', differential amplifier 18, low pass filter 19 through 23, and adjustable gain amplifier 24, 25. The waveform of the input signal to the circuit is shown in waveform 38 of FIG. 3. The input terminals 16, 16' are used to connect the process variable transmitter 2 to the dc blocking capacitors 17, 17'. The dc blocking capacitors 17, 17' are used to remove the effect of low frequency variations caused by normal process changes and to couple only the dynamic part of the process variable to the input differential amplifier 18 to which capacitors 17, 17' are connected. The high pass cutoff frequency of the capacitors 17, 17' and amplifier 18 are selected to match the characteristics of the compressor system 15, usually the cutoff frequency is between 0.1 Hz and 3 Hz. The input differential amplifier 18 is used to amplify and buffer the signal for the filter 19–23. The low pass filter 19–23 connected in series with amplifier 18 is used to remove high frequency noise from the process dynamic signal. The values of the variable resistors 19, 20 and capacitors 21, 22 are selected for a cutoff frequency in use with amplifier 23 to the characteristics of the compressor system 15. Usually the cutoff frequency is between 1 Hz and 20 Hz. The output waveform of the filter is shown in waveform 39 of FIG. 3. Waveform 39 forms the input to the gain amplifier 25 which has a gain adjustment resistor 24. The gain is adjusted to match the characteristics of the compressor system 15, usually between one and one-hundred.

The detector part of the system is connected to gain amplifier 25 as its input and uses a precision absolute-value circuit composed of amplifier 26 and diodes 27, 27' and a peak detector composed of amplifier 28, diode 29, and capacitor 30. The waveform output of the absolute-value circuit amplifier 26 is shown as waveform 40 of FIG. 3. Waveform 40 is then introduced to peak detector amplifier 28. The time constant of the peak detector is selected to match the characteristics of the compressor system 15, usually ten times the reciprocal of the cutoff frequency of capacitors 17, 17' and amplifier 18. The waveform of the peak detector circuit is shown in waveform 41 of FIG. 3.

The transmitter part of the system is composed of a voltage-to-current converter 31 and output terminals 32, 32'. The voltage of waveform 41 across the detector capacitor 30 is buffered and converted to an industrial standard 4 to 20 milliampere signal.

Output terminals 32, 32' are connected to the input of an anti-surge controller 4. The four milliampere signal represents no dynamic process signals and the twenty milliampere signal represents the maximum dynamic process signal.

The power supply 33–37 part of the system uses a voltage regulator connected to the output of the voltage-to-current converter 31 to regulate the varying voltage on the output of the voltage-to-current converter 31 to a fixed voltage for all of the current levels of the circuits.

Figure 4:
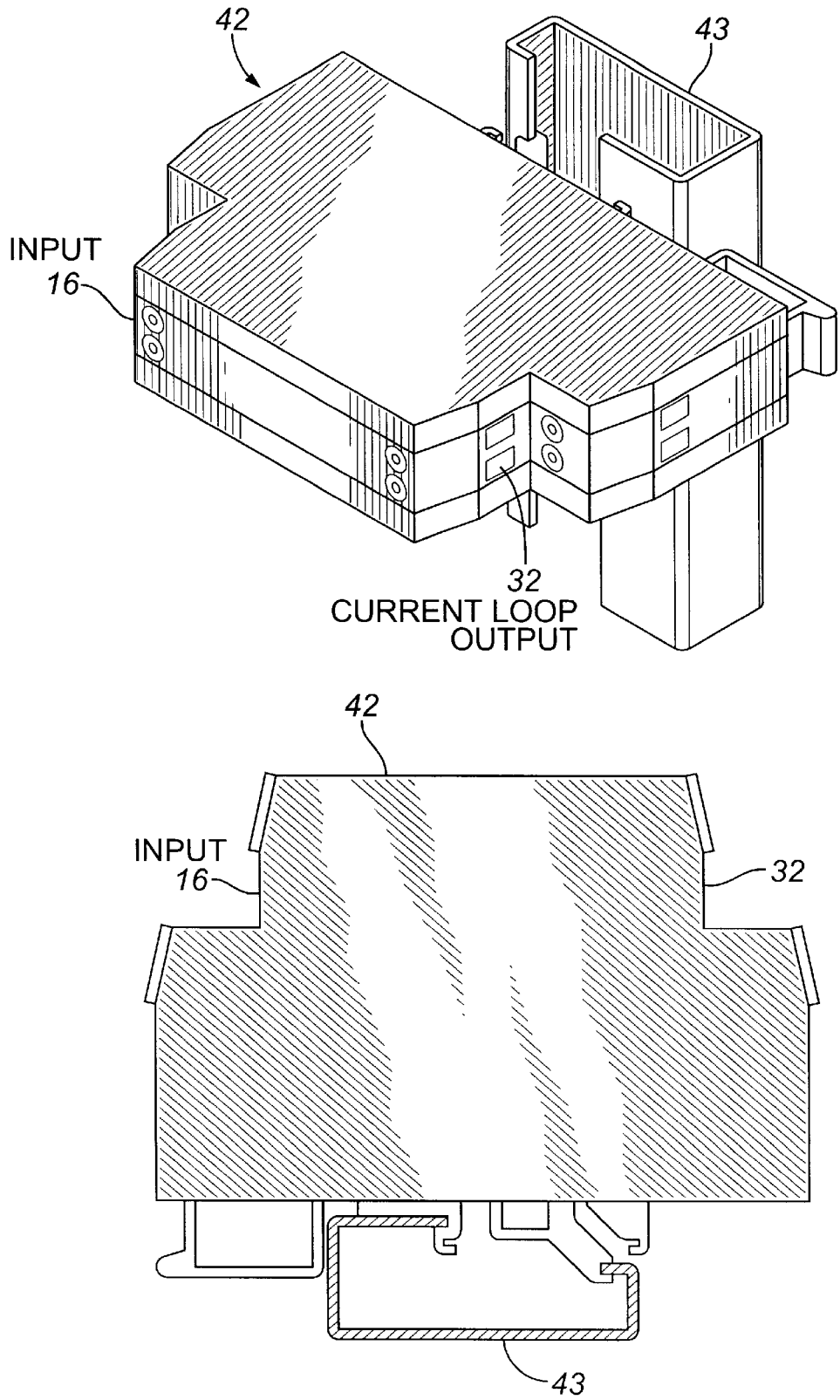
FIG. 4 is a drawing of the enclosure of the signal conditioner device of the preferred embodiment of the apparatus of the present invention; the circuit of FIG. 1 being housed in this enclosure.

Referring to FIG. 4, there is shown an enclosure 42 that attaches to a standard mounting rail 43 housing the circuit of FIG. 2.

What is claimed as invention is:

1. An apparatus for detecting incipient surge of a compressor driven by an electric motor having a signal voltage amplitude of the motor current, comprising:

a first means for detecting the signal voltage amplitude of the motor current;

a converter responsive to the voltage of a said amplitude to convert said voltage to a corresponding electric current level using a peak detection method with a controller decay; and a second means of controlling the change of said electrical current responsive to said amplitude of the motor current.

2. The apparatus of claim 1 wherein said first means includes a filter for the signal voltage amplitude of the motor current.

3. An apparatus for detecting incipient surge of a compressor by separating the dynamic signal from the static signal of a motor current of an electric motor connected to the compressor, comprising:

a dynamic filter to separate the dynamic signal from the static signal, the output of said dynamic filter being a filtered dynamic signal having an amplitude and frequency;

a detector to measure said amplitude of said filtered dynamic signal, having an electric signal output;

a first means for adjusting the frequency of said filtered dynamic signal; and a second means for controlling the change of said electrical signal output of said detector based on the amplitude of said filtered dynamic signal using a peak detector method with a controllable decay.

4. An apparatus for detecting incipient surge of a compressor by separating the dynamic signal having a voltage amplitude from the static signal of a measured variable of the process utilizing the compressor and having a standard mounting rail, comprising:

an electrical signal;

a first means for detecting the voltage amplitude of the dynamic signal; and a second means of controlling change of said electrical signal based on the voltage amplitude of the dynamic signal;

an enclosure;

said first and second means housed in siad enclosure; and said enclosure attached to the standard mounting rail.

5. A process for detecting incipient surge of a compressor driven by an electric motor by separating the dynamic signal from the static signal of a voltage representation of the current of the electric motor, comprising:

detecting the voltage amplitude of the dynamic signal;

converting the voltage to a corresponding electric current level; and controlling the change of the corresponding electric current level by a peak detection method with a controllable decay.

* * * * *